United States Patent [19]

Maguire, III

[11] Patent Number: 4,831,998

[45] Date of Patent: May 23, 1989

[54] PELLET DISPENSER

[76] Inventor: John N. Maguire, III, 149 Cabana Rd., Myrtle Beach, S.C. 29577

[21] Appl. No.: 76,710

[22] Filed: Jul. 23, 1987

[51] Int. Cl.[4] ..... F41C 25/00

[52] U.S. Cl. ..... 124/50; 221/301

[58] Field of Search ..... 124/50, 45–47, 124/49, 53, 52, 51 R, 82; 221/299, 301, 307

[56] References Cited

U.S. PATENT DOCUMENTS

| | | | |
|---|---|---|---|
| 1,645,638 | 10/1927 | Abraham . | |
| 1,786,537 | 12/1920 | Holek . | |
| 2,297,947 | 10/1942 | Dreyer | 124/45 |
| 2,366,448 | 1/1945 | Greene et al. | 124/53 X |
| 2,962,018 | 11/1960 | Tylle | 124/50 |
| 3,319,827 | 5/1967 | Englesson | 221/299 |
| 3,556,071 | 1/1971 | Udesen | 124/50 X |
| 3,584,614 | 6/1971 | Horvath | 124/50 X |
| 3,901,515 | 8/1975 | Mozel | 124/50 X |
| 4,020,974 | 5/1977 | Bauer et al. | 124/50 X |
| 4,173,211 | 11/1979 | Crawford, Jr. . | |
| 4,194,648 | 3/1980 | Stanton | 221/299 |
| 4,222,166 | 9/1980 | Kurek et al. | 221/301 X |
| 4,323,047 | 4/1982 | McIntosh et al. | 124/50 X |
| 4,570,371 | 2/1986 | Mears . | |

*Primary Examiner*—Peter M. Cuomo

*Attorney, Agent, or Firm*—Oltman and Flynn

[57] ABSTRACT

A pellet dispenser comprising an elongated tube for holding pellets end-to-end and a pellet restraining device on the tube. This restraining device comprises (1) a casing straddling the tube near one end; (2) a push-button; (3) a generally U-shaped body extending down from the push button and straddling the tube; (4) a spring biasing the push button and the U-shaped body to a position in which the bottom of the "U" is just beneath the tube; (5) a rigid first stop member extending from the U-shaped body up into tube to engage the front of the first pellet in the tube except when the push button is depressed; and (6) a second stop member with a soft, deformable bottom piece extending from the push button down into the tube to engage the next pellet directly behind the first pellet when the push button is depressed.

4 Claims, 2 Drawing Sheets

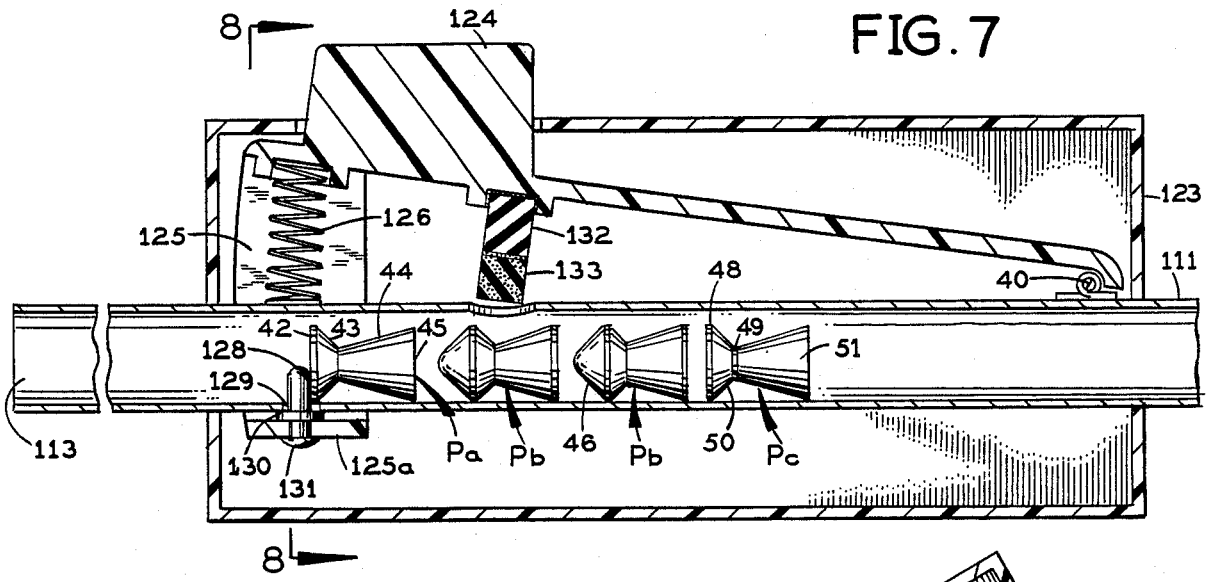
FIG. 7
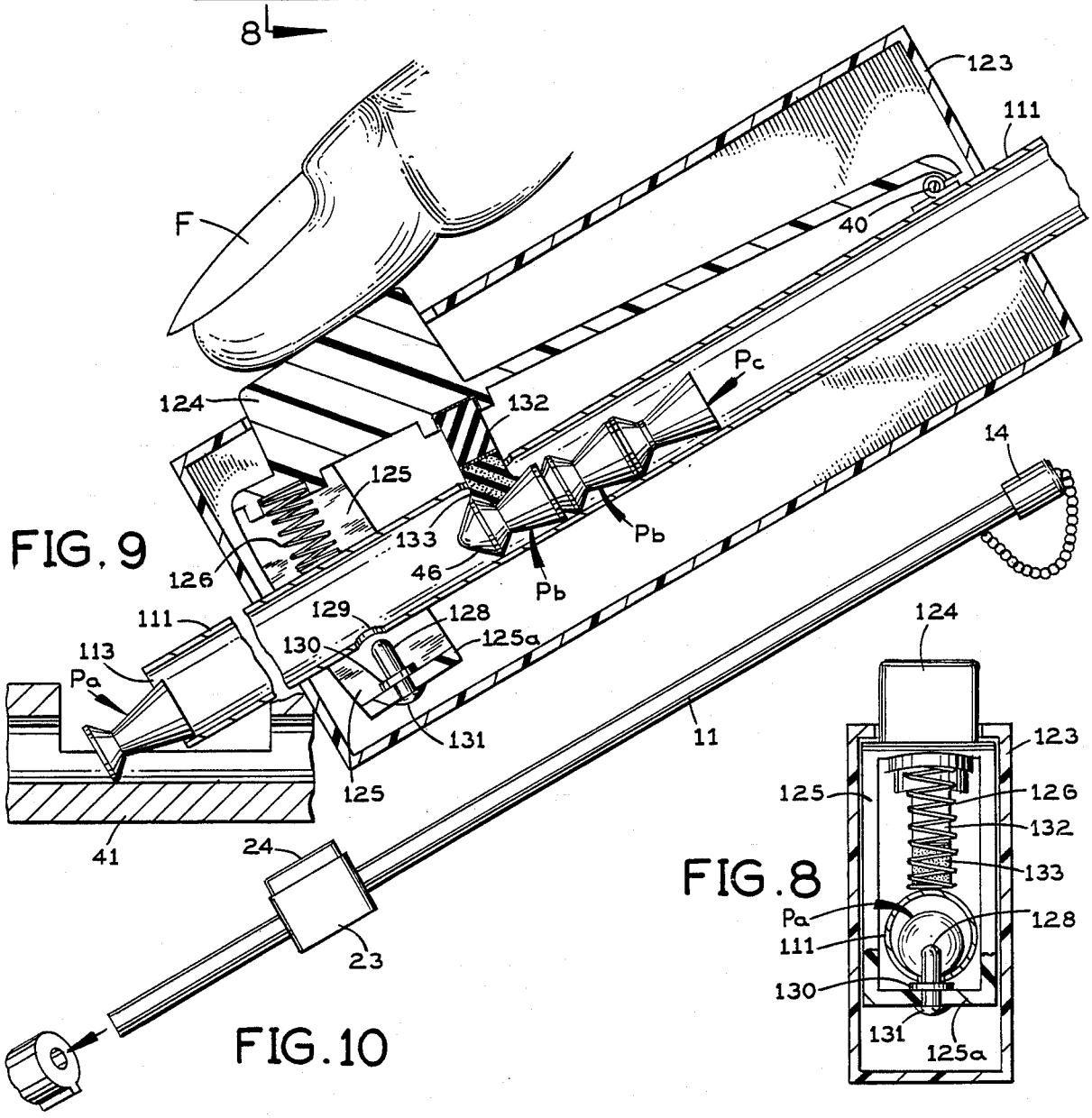
FIG. 9
FIG. 10
FIG. 8

PELLET DISPENSER

SUMMARY OF THE INVENTION

This invention relates to a device for holding a plurality of pellets end-to-end and dispensing them one at a time.

The principal use of this invention is to dispense pellets into a pellet gun, either the side-loading type or the breech-loading type. This invention is adapted to dispense a variety of different-shaped pellets of a given caliber which may occur in a random order in the dispenser. A novel and simplified mechanism in the dispenser is arranged to be actuated in one direction to dispense a single pellet and spring-returned in the opposite direction to a normal position in which it holds the following pellets against removal.

Preferably, the present invention comprises an elongated tube for holding a series of pellets end-to-end and a pellet restraining device on the tube having movable first and second stop members which project inside the tube. A push button is operatively connected to the stop members such that actuation of the push button (1) causes the first stop member to release the first pellet in the series so that it can slide by gravity out of the tube and (2) moves the second stop member into engagement with the next pellet in the series and holds it against sliding out of the tube. When the actuating force on the push button is released it (1) releases the second stop member from the next pellet and (2) moves the first stop member to a position blocking that next pellet from sliding out of the tube. Preferably, the second stop member has a soft, deformable segment for engagement with the second pellet which adapts it for use with differently shaped pellets.

Further objects and advantages of this invention will be apparent from the following detailed description of two presently preferred embodiments which are illustrated schematically in the accompanying drawings.

DESCRIPTION OF THE DRAWINGS

FIG. 7 is a longitudinal section through a second embodiment of the invention;

FIG. 8 is a cross-section taken along the line 8—8 in FIG. 7;

FIG. 9 is a longitudinal section showing a pellet being dispensed from the pellet dispenser of FIG. 7; and FIG. 10 is a front elevation of the pellet dispenser of FIG. 7.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Figure 1:
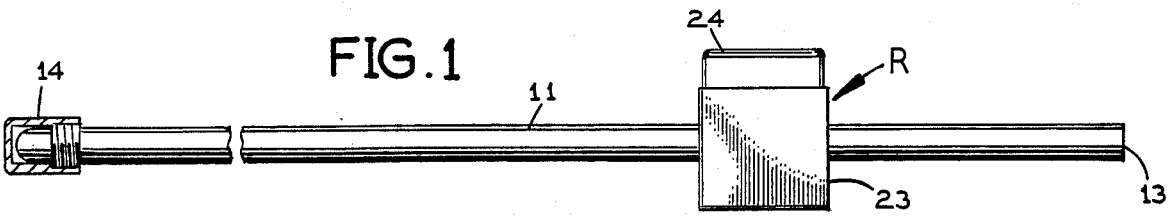
FIG. 1 is a front elevation of a first embodiment of the invention.
Figure 2:
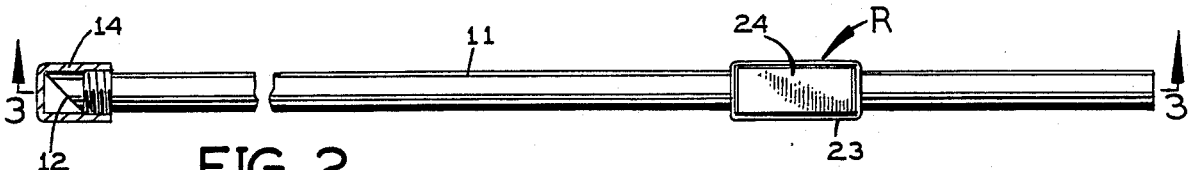
FIG. 2 is a top elevation of the pellet dispenser shown in FIG. 1.
Figure 3:
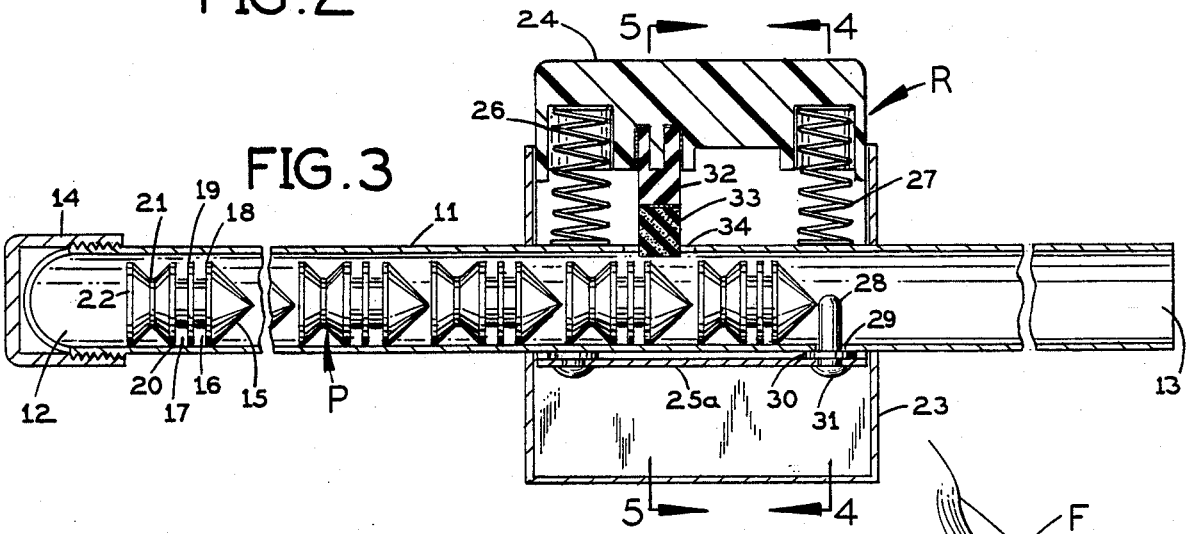
FIG. 3 is a longitudinal section taken along the line 3—3 in FIG. 2.

Referring to FIGS. 1 and 2, the pellet dispenser in accordance with a first embodiment of the present invention comprises an elongated cylindrical tube 11 having a tapered entry opening 12 at one end for the insertion of pellets one at a time and an exit opening 13 at the opposite end through which pellets can leave the tube one at a time. The entry opening 12 may be closed by a threadably insertable and removable end cap, shown at 14. As shown in FIG. 3, each pellet P has a conical nose 15 at the front, a pair of cylindrical grooves 16 and 17 located in close succession behind the nose and separating cylindrical lands 18,19 and 20, an annular groove 21 of generally triangular cross-section behind land 20, and a cylindrical land 22 at its back end behind groove 21.

Figure 4:
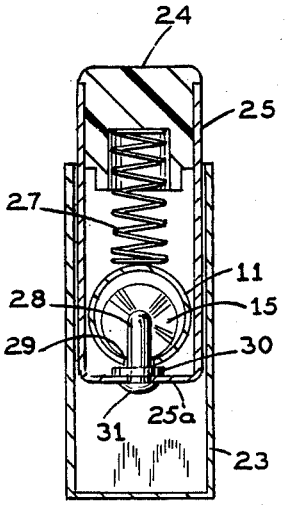
FIG. 4 is a cross-section taken along the line 4—4 in FIG. 3.
Figure 5:
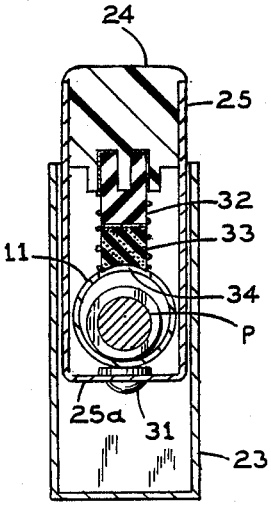
FIG. 5 is a cross-section taken along the line 5—5 in FIG. 3.

A pellet restraining device, indicated generally at R in FIGS. 1 and 2, is mounted on the tube 11 toward its exit opening 13. This restraining device comprises a generally rectangular casing 23 which straddles the tube 11 and is fixedly attached to it in any suitable manner. Casing 23 slidably receives a push button 24 which, as shown in FIGS. 4 and 5, is on the upper end of a generally U-shaped body 25 having a bottom wall 25*a* which is the bight of the "U". Body 25 presents opposite legs which extend down from push button 24 on opposite sides of tube 11 and its bottom wall 25*a* extends between the lower ends of these legs and beneath the tube. A pair of coil springs 26 and 27 (FIG. 3) are engaged under compression between the top of tube 11 and the bottom of push button 24. These springs bias the push button 24 upwardly away from tube 11 and normally position the bottom wall 25*a* of the U-shaped body 25 just below the tube. Push button 24, U-shaped body 25, and springs 26 and 27 constitute a unitary positioning means for first and second pellet-engaging stop members. Casing 23 slidably receives the push button 24 and U-shaped body 25 for reciprocation prependicular to the longitudinal axis of tube 11.

The first stop member is a rigid pin 28 extending up from the bottom wall 25*a* of the U-shaped body 25 through a bottom opening 29 (FIGS. 3 and 4) in the tube 11. The pin 28 has a flat, transverse annular flange 30 and an enlarged head 31 on the bottom which engage the bottom wall 25*a* of U-shaped body 25 from above and below respectively. In the normal position of the parts, under the influence of springs 26 and 27, the bottom wall 25*a* of U-shaped body 25 is separated from the bottom of tube 11 by the thickness of flange 30. In this normal position, the pin 28 engages the point of the conical nose of the first pellet closest to the exit opening 13 of tube 11 and prevents that pellet from moving along the tube to the exit opening.

Figure 6:
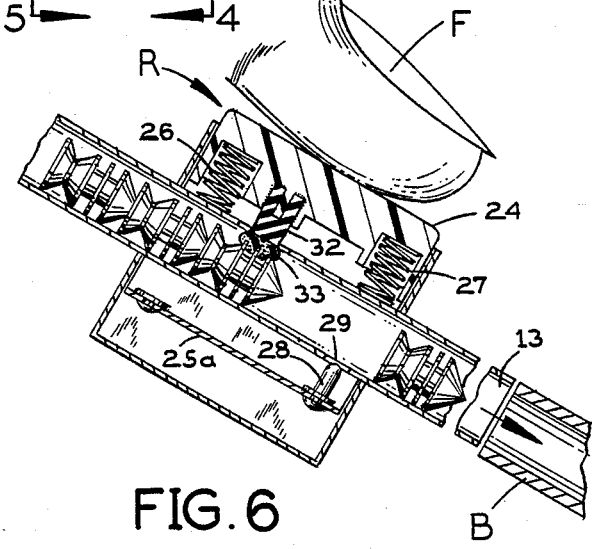
FIG. 6 is a fragmentary longitudinal section showing the dispensing of a pellet from this pellet dispenser.

As shown in FIG. 6, when the push button 24 is pushed toward the tube 11 by a person's finger F, overcoming the bias exerted by springs 26 and 27, the pin 28 is displaced down past the tube opening 29 and out of the way of the pellets, permitting the first pellet to slide along the tube to the exit opening 13. The entire tube 11 is tilted to permit the pellet to slide by gravity into the breech B of a pellet gun of conventional design.

The second stop member in the dispenser is of two-piece construction, including an upper hard rubber or plastic piece 32 affixed to the bottom of push button 24 and a lower piece 33 of soft, compressible and resilient material affixed to and extending down from the upper piece 32. The deformable lower piece 33 preferably is of "neoprene" or other suitable soft rubber-like material. Normally, (FIG. 3) the soft lower piece 33 of the second stop member projects down slightly past a top opening 34 in tube 11 and is spaced slightly above a second pellet which is immediately behind the first pellet that abuts against the first stop member 28.

When the push button 24 is depressed (FIG. 6) it moves the second stop member down until its lower piece 33 is compressed against the lands 18,19 and 20 on the second pellet, holding the second pellet against movement along the tube 11 while the first pellet is sliding down to the exit opening 13 and from there into the pellet gun.

With this arrangement it will be evident that the springs 26 and 27 normally raise the push button 24 and the U-shaped body 25 to a position (FIG. 3) in which the first stop member 28 engages the first pellet and blocks it from the exit opening 13 and the second stop member 32, 33 is disengaged from the second pellet. When the user depresses the push button 24 and tilts the tube 11 (FIG. 6), the U-shaped body 25 moves the first stop member 28 down out of engagement with the first pellet and moves the second stop member 32,33 down into engagement with the next pellet. Consequently, the first pellet is free to slide down and out of the tube while the next pellet is held against movement along the tube. Thus, only one pellet is dispensed from the tube each time the push button 24 is depressed.

FIGS. 7–10 show a second embodiment of the invention which is generally similar to the embodiment of FIGS. 1–6 except that the pellet restraining device is pivoted. Elements of the apparatus of FIG. 7–10 which correspond to those in FIGS. 1–6 have the same reference numerals plus 100, and the detailed description of these elements will not be repeated.

The push button 124 is pivotally mounted at 40 in the casing 123 affixed to the tube 111. A single bias spring 126 is under compression between the top of tube 111 and the movable free end of push button 124.

The U-shaped body 125 (FIG. 8) extending down from push button 124 is integrally joined toit. The opposite legs of the U-shaped body extend down on opposite sides of tube 111 and its bottom wall **125*a*** extends beneath the tube.

FIG. 9 shows this pellet dispenser being used to load pellets one at a time into a side-loading pellet gun 41 of known design.

As shown in FIG. 7, the pellets being dispensed may have different shapes. The first pellet Pa, which engages the first stop member 128 in FIG. 7, has a flat front end face 42, a frusto-conical front segment 43 of progressively smaller cross-section away from the front face, an oppositely tapered frusto-conical back segment 44, and a flat back end face 45. The second and third pellets Pb, have the same general shape as the first pellet Pa except for a rounded, convex front face 46 instead of a conical nose, and a land 47 behind the rounded nose. The fourth pellet Pc is generally like the first pellet Pa except that it has a cylindrical land immediately behind its flat front face 48 and a cylindrical neck 49 between its oppositely tapered frusto-conical front and back segments 50 and 51. As shown in FIG. 9, to dispense a single pellet, the tube 111 is tilted with its exit opening 113 down and push button 124 is depressed manually against the force exerted by spring 126. This moves the first stop member 128 down out of the way of the first pellet Pa, which can slide down out of the tube. At the same time, the push button moves the second stop member 132,133 down into engagement with the next pellet Pb and holds it against sliding down the tube 111 so that only the first pellet is dispensed.

From the foregoing description and the accompanying drawings it will be apparent that the present invention enables a series of pellets, which may be of different shapes (FIG. 7) or the same shape (FIG. 3), to be dispensed manually one at a time into a pellet gun in a convenient, simple and reliable manner. The first embodiment of the invention (FIGS. 1–6) can be used with pellets of different shapes just as well as the second embodiment (FIGS. 7–10). The second embodiment may also be used for breech loading as shown in FIG. 10. The user does not have to handle pellets while shooting and so does not get as much lead on his hands. This helps prevent lead ingestion in the human body.

I claim:

1. A pellet dispenser for dispensing non-spherical pellets of a given caliber one at a time, said dispenser comprising:

an elongated tube for holding pellets in succession end-to-end, said tube at one end presenting an exit opening for passing a single pellet from the tube, each of said pellets having a leading end facing toward said exit opening;

and a pellet restraining device comprising manually displaceable positioning means on said tube, a first stop member consisting of a pin operatively connected to said positioning means to be positioned thereby, said positioning means normally positioning said pin in engagement with the leading end of a first pellet in the tube closest to said exit opening to prevent said first pellet from passing to said exit opening, a second stop member operatively connected to said positioning means to be positioned thereby for engagement selectively with a second pellet in the tube immediately behind said first pellet, said second stop member having a soft, deformable segment facing toward said second pellet and compressible against said second pellet over a substantial part of its surface area axially behind its leading end, said positioning means normally positioning said second stop member out of engagement with said second pellet, and said positioning means being displaceable from its normal position to a pellet-dispensing position holding said pin out of engagement with said first pellet to permit the first pellet to pass along the tube to said exit opening and holding said soft, deformable segment of said second stop member compressed against said second pellet over a substantial part of its surface area axially behind its leading end to prevent said second pellet from moving with said first pellet along the tube toward said exit opening and thereby to separate said second pellet from said first pellet;

said positioning means comprising:

a push button above said tube;

a generally U-shaped body having opposite legs attached to said push button and extending down from said push button outside the tube on opposite sides of the tube and a bottom wall extending between said opposite legs beneath said tube, said generally U-shaped body being movable in unison with said push button with respect to said tube;

spring means acting between said tube and said push button and biasing said push button up away from said tube;

and a casing attached to said tube and receiving said push button and said generally U-shaped body for manual displacement of said push button toward and away from said tube;

and wherein:

said tube has a bottom opening and a top opening therein;

said pin projects up from said bottom wall of said generally U-shaped body at said bottom opening in the tube;

said pin extends up through said bottom opening into the tube when said spring means positions said push button up away from the tube;

said second stop member is attached beneath said push button and extends down from said push button at said top opening in the tube;

and said soft, deformable segment of the second stop member moves down through said top opening into the tube when said push button is pushed down toward the tube against the bias of said spring means.

2. A pellet dispenser according to claim 1 wherein said casing slidably receives said generally U-shaped body for reciprocation of said push button substantially perpendicular to said tube.

3. A pellet dispenser according to claim 1 and further comprising means pivotally mounting said push button inside said casing and above said tube.

4. A pellet dispenser according to claim 1 wherein said second stop member is of two-piece construction including a piece which is said soft, deformable segment and has the physical characteristics of soft rubber and a piece which attaches said soft, deformable segment to the push button and has the physical characteristics of hard rubber.

* * * * *